US007025373B2

(12) United States Patent
Holzer

(10) Patent No.: US 7,025,373 B2
(45) Date of Patent: Apr. 11, 2006

(54) SAFETY SKI BINDING INCORPORATING A TOE AND A HEEL BINDING AND AN ELECTRONIC CIRCUIT AS WELL AS A DISPLAY DEVICE

(75) Inventor: Helmut Holzer, St. Johann (AT)

(73) Assignee: Atomic Austria GmbH, Altenmarkt im Pongau (AT)

( * ) Notice: Subject to any disclaimer, the term of this patent is extended or adjusted under 35 U.S.C. 154(b) by 0 days.

(21) Appl. No.: 10/760,004

(22) Filed: Jan. 16, 2004

(65) Prior Publication Data

US 2004/0145154 A1 Jul. 29, 2004

(30) Foreign Application Priority Data

Jan. 29, 2003 (AT) ..... A 135/2003

(51) Int. Cl.
*A63C 9/10* (2006.01)

(52) U.S. Cl. ..... 280/633; 280/617; 280/816

(58) Field of Classification Search ..... 280/612, 280/611, 633, 616, 617, 816, 632; 307/16, 307/132 E See application file for complete search history.

(56) References Cited

U.S. PATENT DOCUMENTS

| | | | | |
|---|---|---|---|---|
| 3,367,672 | A * | 2/1968 | Tonozzi et al. | 280/612 |
| 3,819,199 | A * | 6/1974 | Smolka et al. | 280/612 |
| 3,892,980 | A * | 7/1975 | Anderson | 280/612 |
| 3,907,316 | A * | 9/1975 | Marker et al. | 280/612 |
| 4,140,331 | A * | 2/1979 | Salomon | 280/612 |
| 4,311,321 | A | 1/1982 | Svoboda | |
| 4,482,168 | A * | 11/1984 | Oberleitner | 280/612 |
| 4,494,768 | A * | 1/1985 | Hull | 280/612 |
| 4,502,146 | A | 2/1985 | D'Antonio | |
| 4,851,706 | A * | 7/1989 | D'Antonio | 280/611 |
| 5,051,605 | A * | 9/1991 | D'Antonio et al. | 280/612 |
| 5,498,017 | A * | 3/1996 | Rohrmoser | 280/633 |
| 6,007,086 | A * | 12/1999 | Hopkins | 280/612 |

FOREIGN PATENT DOCUMENTS

| | | |
|---|---|---|
| AT | 404 901 | 3/1999 |
| DE | 29 26 385 | 1/1980 |
| DE | 32 16 522 | 11/1982 |
| DE | 33 43 047 | 6/1984 |
| EP | 0 469 453 | 2/1992 |
| FR | 2 823 986 | 10/2002 |

* cited by examiner

*Primary Examiner*—Hau Phan
(74) *Attorney, Agent, or Firm*—Collard & Roe, P.C.

(57) ABSTRACT

A safety ski binding (1) with a toe and a heel binding (4,5) and an electronic circuit (6) incorporating an electronic display device (7) and sensor system (8) for displaying at lest one set safety release value of the safety ski binding (1). An evaluation device (13,14) is provided in both the toe binding (4) and the heel binding (5), each of which has at least one sensor (15,16) for detecting at least the set safety release values. Each of the evaluation devices (13,14) respectively has a separate power supply system (21,22) and transmitter between them, only a single display device (7) being provided on the toe binding or on the heel binding (4,5), in particular a display (25) with graphic capability, in order to display the respective values or states of the toe and heel binding (4,5).

21 Claims, 4 Drawing Sheets

SAFETY SKI BINDING INCORPORATING A TOE AND A HEEL BINDING AND AN ELECTRONIC CIRCUIT AS WELL AS A DISPLAY DEVICE

BACKGROUND OF THE INVENTION

1. Field of the Invention

The invention relates to a safety ski binding incorporating a toe and a heel binding and an electronic circuit, with an electronic display device and a sensor system for detecting at least one set safety release value for the safety binding.

2. The Prior Art

Patent specification EP 0 469 453 A1 discloses a safety ski binding with an electronic device for displaying the set safety release force. A display is provided, which displays the values of settings detected and determined by a sensor and an electronic evaluation device. A power supply in the form of a battery is also provided, so that the electrical components can be supplied with power when a switch is activated and deactivated. The sensor, by means of which the set safety release value is detected, is provided in the form of a position sensor, which delivers a characteristic electric sensor signal depending on the position of an adjusting screw used to set the safety release value. It is proposed that a capacitive sensor, an inductive sensor or a plurality of micro-switches should be used for the sensor. Another suggestion is that a potentiometer and an adjustable resistor be used as a means of electronically detecting the respective position of the adjusting screw. The disadvantage of this system is that an analogue signal evaluation of the virtually static or absolute position sensors is necessary, which means that the electronic components have a high sensitivity to interference and a low output range. Although this system enables the safety release value set at any one time to be electronically detected and presented on a display, it is not possible to detect changes in the safety release value.

An electronic display device for indicating the release force set on a safety ski binding is known from patent specification DE 33 43 047 A1. In this case, the spring-biassing action of the releasing mechanism is detected by an electromechanical transformer, which converts the prevailing spring biassing force into electrical information. An electronic circuit converts this information to a digital format so that it can be presented on a digital display system. A potentiometer is also proposed, which measures any variation of the adjusting screw relative to the binding housing. Here again, problems can arise in respect of processing the signal as well as the resistance of the electronic system to interference due to the analogue signal evaluation of the sensor measuring absolute force or pressure and the proposed ohmic potentiometer.

Patent specification DE 29 26 385 A1 and patent document U.S. Pat. No. 4,311,321 A belonging to the same patent family disclose a safety ski binding with several electric switching elements for detecting a whole range of operating states of a safety ski binding. In this case, both the toe binding and the heel binding are provided with electrical switch contacts, by means of which various states can be detected, such as, for example any excess accumulation of snow, wear of the soles, incorrect clamping pressures, incorrect height settings of the sole holder and open and closed heel bindings. These single-pole or multi-pole switch contacts, in particular the grouped normally open contacts or switch contacts, are disposed on the toe binding and heel binding and are integrated by means of an electric power supply and a display lamp to form an electric display circuit.

If one of the switch contacts is activated due to the occurrence of safety-critical or incorrect states, the display lamp is illuminated or a summer is activated, indicating the fact that the binding has assumed an admissible or safety-critical state. The disadvantage of this system is that when the display lamp is illuminated or flashes, it is not evident what inadmissible operating state has occurred and the user has to make several attempts to find out what the problem is in order to take appropriate measures to return to the correct status. Quite apart from the fact that this display device offers very little in the way of meaningful information, another disadvantage of this system is that the electrical wire connections between the switch elements of the toe binding and the power supply system and display lamp as well as between the switch elements of the heel binding and the power supply system and display lamp restrict the mechanical variability of the ski binding parts and the wire connections must be capable of withstanding high electromechanical demands.

Patent specification DE 32 16 522 A1 discloses a safety ski binding with two bindings and an electrically controlled safety release mechanism which is operated in the event of dangerously high forces. In this case, a sensor is provided in at least one of the bindings, which detects the prevailing forces and stresses and transmits them contactlessly to a signal processing circuit housed in the ski body. In particular, there is no galvanic or electrically conductive connection between the sensor in the binding and the signal processing circuit in the ski body. A transmitter-receiver system is provided for this purpose, in the form of inductively coupled coils or isolated capacitively coupled conductive films or surfaces, for example. Both the sensor signal and also the electrical power needed to operate the sensor and the electromechanical release mechanism in the binding body are transmitted via this transmitter and receiver system. The disadvantage of this system is that high electric outputs are necessary in order to ensure reliable signal and power transmission across a distance of a few centimeters. There is no mention of a system for displaying useful or important states and settings in this earlier known binding.

Patent specification U.S. Pat. No. 4,502,146 A describes a setting means for setting values in a ski binding electronic system without the need for contacts. In this instance, Hall-effect sensors, light-sensitive sensors or piezoelectric devices are used to change values in a system of binding electronics which is inaccessible or encapsulated. This obviates the need for guides and rotary mountings needed for potentiometers or other electromechanical adjusting elements, which often cause problems due to sealing because ingress by moisture poses a risk of short-circuiting or distortion of the actual conditions prevailing at any one time. Although the proposed adjusting means make it possible to set and adapt electronic settings without contact and without any susceptibility to external influences, such as moisture, for example, the proposed design does not allow the safety settings or prevailing states of a safety ski binding to be checked.

Patent specification AT 404 901 B discloses a ski binding with an electronic display device and a sensor system, by means of which the relative position of the ski binding with respect to the ski or the distance between the toe and heel binding can be detected and displayed. Travel or force measurement transmitters are also proposed, by means of which the releasing force set for the ski binding is measured and transmitted via wires to the evaluation device, thereby enabling the position values to be shown in the form of a digital presentation on the display. The disadvantage of this system is that these line connections between the respective measurement transmitters or sensors and the display device make the ski binding more complex and the range of electronic functions of the proposed ski binding is limited due to the degree of complexity involved in achieving a reliable signal or power transmission. In addition, because the range of functions performed by the components is predefined, there is barely any possibility of extending them subsequently. The line connections between the electronic components are also susceptible to breakage when exposed to stress or, alternatively, extensive electromechanical measures have to be taken to compensate for this, increasing complexity still further and incurring a considerable increase in costs.

SUMMARY OF THE INVENTION

The underlying objective of the present invention is to propose a safety ski binding, in which settings pertaining to safety or of general interest as well as respective operating states are electronically detected and monitored and which, in spite of having a larger number of functions, is nevertheless simple in terms of design and of a construction that is as cost effective as possible and functionally reliable for long periods.

This objective is achieved by a safety ski binding in which an electronic evaluation device is provided in both the toe binding and in the heel binding, each with at least one sensor for detecting the respectively set safety release values, and each of the evaluation devices has a separate power supply system and transmitter and/or receiver device to enable wireless, one-way or two-way data or signal transmission between them, and only a single display device is provided on the toe binding or on the heel binding, in particular a display with graphic capability, for displaying the respective values or states of the toe and heel binding.

One of the advantages of the ski binding proposed by the invention is the fact that the safety setting, in particular the so-called Z numbers, are electronically acquired or recorded and both the prevailing settings for the toe binding and the prevailing setting for the heel binding can be displayed. This means that not only is the setting for the release or clamping threshold of the toe binding electronically detected, the setting of the release or retaining threshold for the heel binding, which can be adjusted essentially separately, is electronically detected and displayed so that it can be indicated at least visually. This extended function can therefore be used to run a simple and consistent check of the safety settings of the safety ski binding as a whole, comprising toe binding and heel binding, at any time, for example by the user of the ski binding. In addition, the settings to be applied are more accurate and any differences in the settings between the toe binding and heel binding of a safety ski binding and differences in the settings of one safety ski binding used as one of a pair will be immediately apparent. The improved functions of the electronic safety ski binding therefore represent an increase in safety and offer convenience in terms of reading and adjusting settings. In spite of having these extra functions and separate electronic units in the toe binding and heel binding, the safety ski binding proposed by the invention nevertheless offers a high degree of operating reliability for longer periods, even when used in adverse environmental conditions. In particular, the fact that the signal or data transmission between the mutually independent or autarchical electronic units of the toe and heel bindings operates wirelessly or without contact rules out all risk of operating failure due to poor electrical contacts. It would also be a costly matter to fit the toe and heel bindings with power connections because appropriate precautions would need to be taken, involving insulation in particular, in order to prevent short-circuiting. Wireless signal and data transmission also obviates the need for any sliding contact connections or conductor loops for electrical signal transmissions between parts which move relative to one another and are therefore susceptible to damage, such as between the ski and its binding plate and the housing of the toe and heel binding. In particular, a wireless high-frequency radio signal transmission can be operated unhampered between the toe binding and heel binding from a whole range of changing positions between the toe and/or heel binding and the ski. More especially, the electronic system of the safety binding unit will not be adversely affected if the relative position of the entire safety ski binding is adjusted relative to the ski or if the binding distance is altered in order to adapt to different shoe sizes. All in all, these factors make for increased operating reliability, even if the safety ski bindings have been mechanically adjusted or reset many times. Another advantage of the safety ski binding proposed by the invention is the fact that the user has a better overall view or overall control, because only one electronic display device is provided, in addition to which the overall cost of the safety ski binding proposed by the invention can be kept low. The fact that the display of states or values of the toe binding and heel binding is centralised increases convenience during operation, facilitating the ability to take readings of useful or system-relevant states or values.

Also of advantage is another possible embodiment of the safety ski binding, in which the evaluation device provided in the heel binding has a sensor which determining or checking a clamping pressure of a slip-on spring system of the heel binding relative to a ski shoe, enabling automatic detection and checking of the clamping pressure of the ski binding on a ski shoe inserted therein without problem. Particularly if the display of the prevailing clamping pressure is disposed in the region of the toe binding, the respective value of the setting will be within the line of sight of the user of the safety ski binding. Although it is more practical to detect the clamping pressure at the heel binding, the display of the respective clamping pressure can quite easily be disposed on the toe binding. This is a more expedient way of alerting the user of the safety ski binding if the clamping pressure is not correct, enabling him to take whatever steps are necessary, such as cleaning the ski shoe and the ski binding parts or correctly adjusting the slip-on spring system, for example.

Advantages are also to be had from another embodiment of a safety ski binding, in which the evaluation device in the heel binding has at least one sensor for detecting whether the heel binding is in the open and/or closed state, which will immediately enable the user of the safety ski binding to see whether the safety ski binding was correctly fastened or is stuck in safety-critical intermediate positions or partially open positions, even though he may have assumed that the ski shoe had been correctly inserted in the safety ski binding. The level of safety which can be achieved using the safety ski binding proposed by the invention can also be improved with this design. The electronic components that are provided as a means of detecting the safety release values bring an improvement in efficiency.

In one practical embodiment of the sensor system for detecting the safety release values, this sensor is provided in the form of at least two Hall-effect sensors and a multi-pole magnet rotatingly connected to a screw for adjusting the release values is provided within its detection range. The advantage of this is that this sensor system is not very sensitive to thermal and mechanical influences at all and provides a good solution in terms of the technology used to measure the set safety release value. Another advantage is the fact that no mechanical converters or gear systems are needed to obtain a high resolution or a sufficiently fine measurement variable and adjustment range. This particular embodiment is also not susceptible to ingress by moisture or liquid and will remain so over long periods.

In another embodiment of the safety ski binding, the Hall-effect sensors are spaced apart from one another in the circumferential direction of the ring magnet and at least one digital sensor signal is generated when the adjusting screw is turned, and the evaluation device is configured with at least one counter to count or record the pulses or periods of at least one sensor signal, the advantage of which is that the detection sensors operate with a lower power consumption and the safety ski binding will therefore remain fully functional for long periods without requiring any maintenance. Another advantage is the fact that an incremental distance measuring system or a so-called incremental transmitter is used as the detection sensor, making the binding electronics very robust.

There are advantages to be had from another embodiment of the safety ski binding, in which a value denoting pulses or periods to date is incremented or decreased and stored in a non-volatile memory system depending on the direction in which the adjusting screw is rotated and hence depending on the phase position of the sensor signal of the first Hall-effect sensor relative to the sensor signal of the second Hall-effect sensor as the adjusting screw is turned, enabling the signal to be digitally processed, making it highly insensitive to interference, and also enabling increases and decreases in the measurement to be reliably detected, in particular the adjustment width or the rotation angle of the adjusting screws.

In another embodiment of the safety ski binding, the sensor which electronically detects the forward pressure is provided in the form of a magnetic field sensor, in particular a GMR (Giant Magneto Resistive) sensor, the advantage of which is that it not only enables the clamping pressure to be detected on a virtually binary basis in the form of an "OK" or "not OK" indication, it also enables intermediate values and several ranges of values to be detected and evaluated for different variations from the desired clamping pressure.

In another advantageous embodiment of the safety ski binding, the magnetic field sensor is attached to a housing of the heel binding so as to be prevented from moving and a permanent magnet or metal part is provided on a part of the slip-on spring system which moves relative to the magnetic field sensor, which means that a genuine distance measurement is taken, providing a simple means of drawing conclusions about the clamping pressure prevailing at any one time on the basis of the different distances. The fact that the magnetic field sensor is fixedly mounted on the housing and its electric terminals are borne on the binding housing is another advantage because even though there are relative movements, there is no need to provide cable loops and line connections to compensate for movements.

Another advantageous embodiment of the safety ski binding is one in which the sensor used to detect the open and closed position is provided in the form of a first Hall-effect sensor and a second Hall-effect sensor, the first Hall-effect sensor being provided as a means of signalling the open state and the second Hall-effect sensor as a means of signalling the closed state, which provides a particularly reliable sensor system that is not susceptible to interference, whilst at the same time enhancing accuracy during detection of the prevailing state, because each of the two end positions are monitored and detected by a separate sensor, which also provides a simple means of enabling inadmissible intermediate positions to be detected.

As a result of another advantageous embodiment, the electrical power consumption is reduced or minimised due to the fact that the evaluation device is provided with at least one sensor which periodically activates or deactivates the electrical power supply.

Another advantageous embodiment also enables power consumption to be reduced by automatically switching electronic components into an off-mode or power-saving mode, and in this advantageous embodiment of the safety ski binding, the evaluation device provided in the toe binding and/or the evaluation device provided in the heel binding is connected to a motion sensor.

A considerable saving on the power consumed by the electronic components can be achieved by another embodiment of the safety ski binding, in which the electronic evaluation device is switched off or switched to a power-saving mode if the signal status of the motion sensor is constant over a specific period of time, so that power consumption is negligible or zero during long periods of non-use, for example during the summer months or at night.

In another embodiment of the safety ski binding, the evaluation device is programmed so that it evaluates the signal states of the motion sensor as a priority in a sleep or power-saving mode and the other functions of the evaluation device are deactivated or minimised, the advantage of which is that power consumption is extremely low during phases in which the functions of the binding electronics are not needed and the ski binding and binding electronics can therefore be used for long periods without maintenance, even though the maximum capacity of the batteries or accumulators is limited. Furthermore, the binding electronics can be automatically reactivated in a perfectly simple manner, immediately there is any movement, in order to perform the appropriate tasks.

Another advantageous embodiment of the safety ski binding is one in which the display device is switched off depending on the signals from the motion sensor and depending on a specific period of time which elapses without any movement being registered by the evaluation device or the motion sensor, because the power consumption of the display device can be minimised or reduced to zero during phases in which it is not required, which means that the power supply systems, in particular the electrochemical voltage sources, can continue to supply the electronic components with the appropriate power for the longest possible time.

Also of advantage is another embodiment of the safety ski binding, in which the evaluation device in the toe binding is programmed to switch off or transfer the display device into a power-saving mode on detecting a change of the heel binding from the closed into the open state, which means that when the ski binding is taken off or opened in any other manner, such as by a safety release mechanism for example, the display device can be immediately switched off to reduce the power consumption of the electronic components in the ski binding.

Finally, in another embodiment of the safety ski binding, the transmitter and/or receiver device are designed for wirelessly transmitting data signals to and/or for wirelessly receiving data signals from a peripheral electronic computer unit, in particular a wrist-top computer, a handheld computer, a mobile telephone or any other mobile electronic unit, the advantage of which is that it obviates the need for structurally complex and cost-intensive input means on the electronic ski binding. This specifically means that a stand-alone electronic computer unit can be used as the programming and/or operating and/or display means for the electronic system in the safety ski binding. Since nothing or only very simple means are needed for input purposes, there will barely be any problems in terms of external disruptive influences, such as liquids, vibration, mechanical stress and similar. Moreover, this all adds to the functionality, versatility and user convenience, whilst facilitating maintenance work, servicing and adaptation to the electronic system of the safety ski binding.

BRIEF DESCRIPTION OF THE DRAWINGS

The invention will be described in more detail below with reference to the appended drawings illustrating examples of embodiments.

Of these.

DETAILED DESCRIPTION OF PREFERRED EMBODIMENTS

Figure 1:
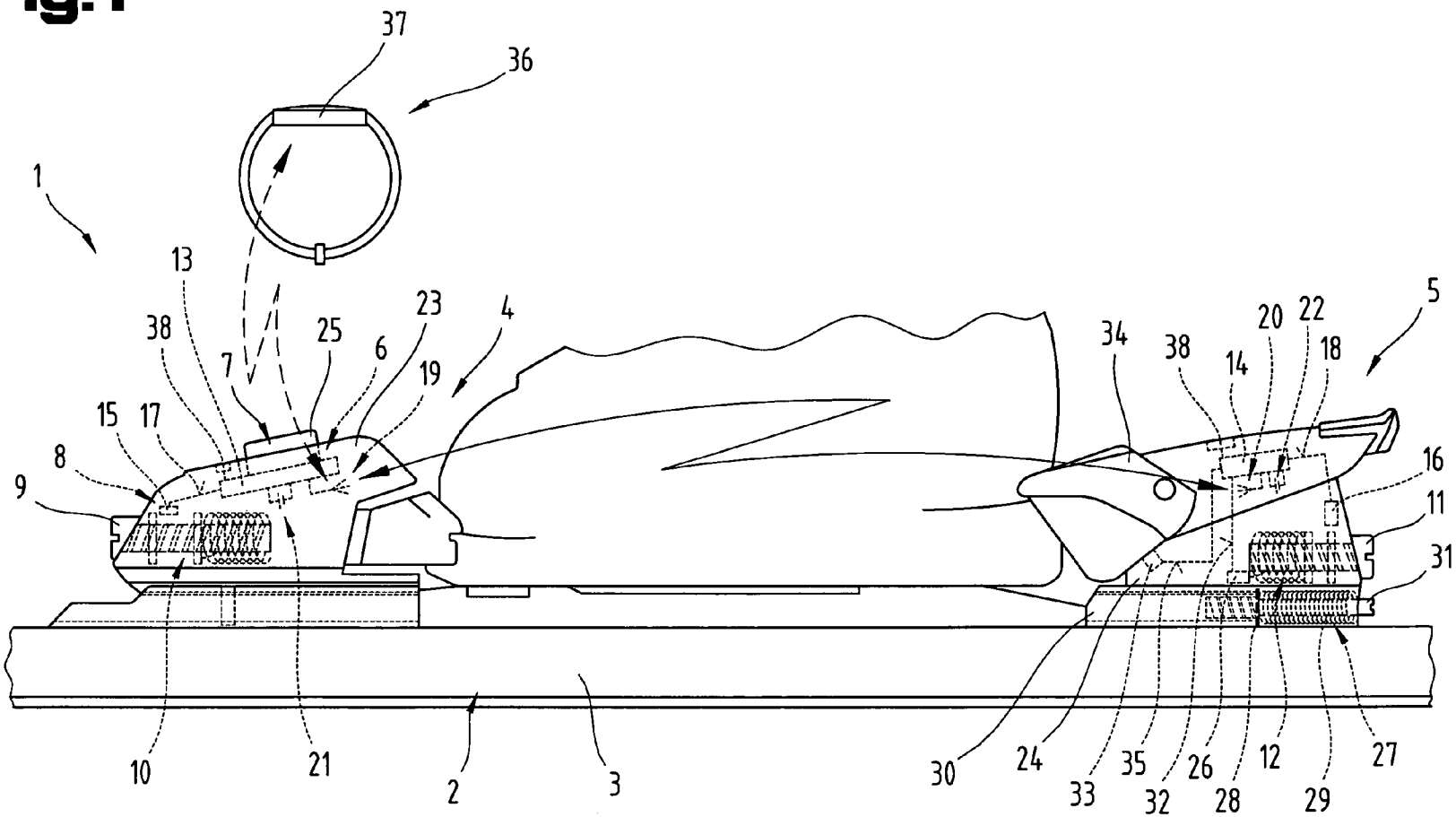
FIG. 1 is a highly simplified, schematic diagram depicting one possible embodiment of a safety ski binding as proposed by the invention in combination with an optional external computer or electronic unit, seen from a side view.

Firstly, it should be pointed out that the same parts described in the different embodiments are denoted by the same reference numbers and the same component names and the disclosures made throughout the description can be transposed in terms of meaning to same parts bearing the same reference numbers or same component names. Furthermore, the positions chosen for the purposes of the description, such as top, bottom, side, etc,. relate to the drawing specifically being described and can be transposed in terms of meaning to a new position when another position is being described. Individual features or combinations of features from the different embodiments illustrated and described may be construed as independent inventive solutions or solutions proposed by the invention in their own right.

FIG. 1 is a highly simplified diagram symbolising one possible embodiment of a safety ski binding 1 as proposed by the invention. In a generally known manner, a safety ski binding 1 of this type is used as one of a pair as a means of fastening a sports shoe, in particular a so-called ski boot, to a board type runner device 2, in particular a pair of skis 3.

The safety ski binding 1 essentially consists of a toe binding 4 for retaining the toe region of a sports shoe and a heel binding 5 for retaining the heel region of a sports shoe inserted in the safety ski binding 1. A binding support plate, which is schematically indicated, may optionally also be provided between the front and/or heel binding 4, 5 and the ski 3.

Adjusting and setting mechanisms may also be provided on this safety ski binding 1—as schematically indicated—for individually adjusting the position of the toe and/or heel binding 4, 5 relative to one another and/or the unit comprising the toe and heel binding 4, 5 relative to the longitudinal extension of the ski 3. These adjusting and setting mechanisms, which come in a whole variety of types known from the prior art, enable the ski binding 1 to be effortlessly adapted within predefined limits to the respective shoe size or sole length and/or to re-position the points at which forces are transmitted between the ski binding 1 and the ski 3 or binding plate in the longitudinal direction of the ski 3.

The safety ski binding 1 also has an electronic circuit 6. This circuit 6 preferably incorporates a display device 7 connected to at least one sensor system 8. The circuit 6 is provided at least as a means of detecting and displaying a set safety release value of the safety ski binding 1. The safety ski binding 1 has—in a generally known manner—a predefined setting range for the safety release value or maximum retaining force on the ski shoe, so that a particular binding type can accommodate a whole range of conditions and users. This safety release value or so-called Z number can be adapted to the individual requirements of the respective user as well as safety requirements by means of an adjusting screw 9 on a release mechanism 10 in the toe binding 4. Likewise, this safety release value or Z number can be varied or set by means of an adjusting screw 11 on a separate release mechanism 12 in the heel binding 5. The purpose of these release mechanisms 10, 11 or variably adjustable release mechanisms in the toe and heel bindings 4, 5 is to effect a controlled release of the sports shoe from the runner device 2—in a manner known per se—in the event of excessive stress likely to incur a risk of injury to the user. The essential point is that because the release mechanisms 10, 12 are independent of one another, there can be no deviation from the settings of the safety release values.

The safety release value set respectively for the toe and heel binding 4, 5 can be viewed on the display device 7. To this end, an electronic evaluation device 13 and 14 of independent construction is provided in both the toe binding 4 and in the heel binding and evaluation devices 13, 14 are provided which are specifically allocated one to the toe binding 4 and the other to the heel binding 5. The evaluation device 13 cooperating with the toe binding 4 and the evaluation device 14 co-operating with the heel binding 5 and located at a distance apart from it are each provided with at least one sensor 15 respectively 16 for detecting at least the respective setting of the safety release value. In particular, an electrical line connection 17 is provided inside the toe binding 4, between the sensor 15 and the evaluation device 13, and a separate line connection 18 is provided in the heel binding 5 between the sensor 16 and the evaluation device 14 the sensors 15, 16 are not provided in the form of position sensors or pressure sensors for the absolute detection of forces or tensions but are provided instead in the form of pulse transmitters or incremental transmitters, which detect increments during the respective adjustment and setting procedures on the release mechanisms 10, 12, as will be described in more detail below. In other words, the sensors 15, 16 monitor and detect any change in the release mechanisms 10, 12, in particular any shift or rotation of the adjusting screws 9, 11. By electronically detecting the positional width and positional direction as well as the shift in angular rotation of the adjusting screw 9, 11—which may include several rotations—in a manner that will be described in more detail below, the respective evaluation device 13, 14 will calculate the currently valid setting of the safety release values, taking account of the setting values that were last valid, which again will be explained in more detail below.

The evaluation device 13 disposed in the toe binding 4 and the evaluation device 14 disposed in the heel binding 5 each have a respective transmitter and/or receiver device 19, 20 for high-frequency, electromagnetic waves or radio signals. The frequency range of the transmitter and/or receiver device 19, 20 is preferably in what is known as the ISM (Industrial Scientifical Medical) frequency range, which extends from the MHz (Megahertz) range to the GHz (Gigahertz) range. In particular, signal and data transmissions are expediently operated in the HF range, for example at 13.56 MHz and 27.125 MHz or in the UHF range of 400 to approximately 950 MHz.

These transmitter and/or receiver devices 19, 20, which may also be designated as HF modules, enable a wireless, one-way or two-way data communication or signal transmission between at least the evaluation device 13 co-operating with the toe binding 4 and the evaluation device 14 co-operating with the heel binding 5. The transmitter and/or receiver devices 19, 20 are also used for wirelessly or contactlessly receiving and/or transmitting high-frequency electromagnetic waves. These transmitter and/or receiver devices 19, 20 specifically enable a one-way or two-way transmission of radio signals, at least between the mutually spaced apart evaluation devices 13, 14 in the toe and heel bindings 4, 5.

To enable operation of the toe binding and heel binding electric components, an electric power supply system 21, respectively 22 is provided for both the toe binding 4 and the heel binding 5. These power supply systems 21, 22 are preferably provided in the form of electrochemical voltage sources, in particular batteries or accumulators, which are preferably mounted in or on the binding bodies. These power supply systems 21 and 22 are respectively connected to an adjacently lying evaluation device 13 or 14 and are preferably accommodated in a housing 23 of the toe binding 4 or in a housing 24 of the heel binding 5.

The design described above advantageously provides a simple means of ensuring that no electrical wire connections are needed between components which move relative to one another. In particular, no flexible wiring or loop contact connection or power-transmitting mechanisms are needed between relatively displaceable elements, such as one of the bindings of the safety ski binding 1 and the runner device 2 or the binding support plate or between the toe and heel bindings 4, 5 which are at least slightly displaceable relative to one another during active operation of the runner device 2. This slight relative displacement between the toe and heel binding 4, 5 and between at least one of these binding bodies and the ski 3 is permitted and controlled by means of a so-called slip-on or longitudinal spring compensating system, which is usually accommodated in the heel binding 5. The electronic units integrated in the toe binding 4 and in the heel binding 5 will therefore be reliable in operation, offering a high degree of protection against operational failure for long periods, and even if used frequently in adverse environmental conditions.

Only one display device 7 is provided on the safety ski binding 1 and is preferably disposed on the toe binding 4 or on the heel binding 5, to display the respective values of the toe binding 4 and the heel binding 5 as well as the respective states of the safety ski binding 1. This display device 7 is likewise connected to the housing 23 of the toe binding 4 or alternatively to the housing 24 of the heel binding 5 so that the display surface is readily visible to the user of the safety ski binding 1. Accordingly, the display device 7 is preferably disposed on the top face of the toe binding 4. The display device 7 together with the co-operating evaluation device 13 may optionally constitute a single unit. Otherwise, a separate line connection may also be run between the display device 7 and its controller and the evaluation device 13. This will be the case in particular if the evaluation device 13 is provided in the region of the bottom face of the toe binding 4 due to restricted space in the binding bodies, for example, and the display device 7 will be arranged in the upper region of the housing 23 of the toe binding 4.

The essential factor is that the relevant values or settings of the binding that does not have a display device can therefore be wirelessly transmitted to the binding which does have appropriate display or viewing facilities. Although this should not be construed as restrictive, in a preferred embodiment the values and settings of the heel binding 5 detected by sensors are wirelessly or contactlessly transmitted via the evaluation device 14 or the transmitter and/or receiver device 20 to the transmitter and/or receiver device 19 in the toe binding 4 and displayed on the display device either directly or via the evaluation device 13, with a clear indication as to whether the displayed values relate to the toe binding 4 or the heel binding 5. It may optionally also be possible to present a simultaneous display of values and data for the toe binding 4 and the heel binding 5 on the common display device 7, with indications to make it immediately obvious to the user which values relate to the toe binding 4 and which relate to the heel binding 5.

If the display surface of the display device 7 used jointly by the toe and heel bindings 4, 5 is of a smaller design, the values for the toe and heel binding 4, 5 can be displayed consecutively with a code indicating which is which.

The display device 7 is preferably a display 25 with graphic capability, in particular a LCD display, which enables a plurality of graphic, freely programmable symbols, graphics or texts and numbers to be displayed. It is preferable if a broad range of graphic symbols can be presented on the display 25, by means of which the respective information and messages can be seen by the user as clearly as possible. Displaying graphic symbols on the display 25 obviates the need for at least some word processing tasks, thereby avoiding any problems in terms of presentations as well as problems with regard to different languages, which would otherwise be encountered by different users of the safety ski binding. Controlled by the evaluation device 13 and the evaluation device 14, it is therefore preferable if the display 25 shows only figures or individual letters, for example a "Z" and/or graphic symbols or texts which are universally understandable such as "OK" or "OPEN", for example.

In one advantageous embodiment, the logo or a trade mark of the manufacturer of the safety ski binding 1 or the runner device 2 and/or the type and brand name of the ski binding 1 are indicated on the display 25—controlled by at least one of the evaluation devices 13, 14. Likewise, the display 25, comprising a plurality of image dots or pixels, can be used to present graphic animations.

The evaluation device 14 disposed in the heel binding 5 is preferably also connected to another sensor 26 for detecting a clamping pressure of a slip-on spring system 27 of the heel binding 5.

In a known manner, this slip-on spring system 27 ensures that a ski shoe inserted in the safety ski binding 1 is retained between the toe and heel bindings 4, 5 with as little clearance as possible. This slip-on spring system 27 may also be used at least partially to compensate for and absorb angular changes and changes in the spacing between the toe and heel bindings 4, 5 and the ski 3 and binding support plate as the ski 3 bends. Such a slip-on spring system 27 comprises, for example, a thrust bearing 28 fixedly joined to the ski or a thrust bearing fixedly joined to a single-piece or multi-part strip-shaped connecting element between the toe and heel binding 4, 5. Co-operating with this stationary thrust bearing is an elastically flexible element, for example a helical spring 29, which permits limited relative movements between the housing 24 of the heel binding 5 and the ski 3 and with respect to a longitudinal guide 30 for the heel binding 5 permanently joined to the ski. The biassing force of the elastic thrust bearing, in particular the helical spring 29 and hence the characteristics of the slip-on spring system 27, are adjustable via an adjusting screw 31 and/or such an adjusting screw 31 may be used to vary the relative position of the heel binding 5 with respect to the longitudinal guide 30 and with respect to the ski 3 if necessary, in order to accommodate different shoe sizes or make an adjustment to the forward pressure. When the ski shoe is inserted in the safety ski binding 1, the elastic element, in particular the helical spring 29 of the slip-on spring system 27, is biassed, preferably slightly compressed, and the heel binding 5 is moved in the longitudinal guide slightly in the direction towards the ski end so that the ski shoe is inserted without any clearance between the toe and heel binding 4, 5 under the action of the slip-on spring system 27.

Within the context of the invention, it would naturally also be possible to use such a slip-on spring system 27 or a similar compensating mechanism in the toe binding 4 or in the toe and heel binding.

The degree of displacement and the clamping pressure exerted by the slip-on spring system 27 relative to an inserted ski shoe is important to correct operation and safety as well as the operating efficiency which can be achieved by the safety ski binding 1. In particular, too low a clamping pressure can lead to undesirable relative movements between the safety ski binding 1 and the ski shoe, whilst too high a clamping pressure can be detrimental to the performance and bending characteristics of the ski 3 or can have too great an influence on or distort the safety release values set for the toe and heel bindings 4, 5.

The purpose of the sensor 26, therefore, is to control and detect the clamping pressure of the slip-on spring system 27 and it records and monitors the relative position of the heel binding 5, in particular its housing 24, relative to a fixed point of the ski, for example relative to the longitudinal guide 30 or relative to a strip-shaped connecting element or relative to a thrust bearing 28 on the ski 3 or the binding support plate.

The sensor 26 of the slip-on spring system 27 may therefore be provided in the form of a pressure or force sensor or alternatively acts as a travel or distance sensor. In particular, the sensor 26 detects the presence of an object to be detected, for example a metal part or a permanent magnet, relative to a sensor surface or its detection range. The characteristic electric sensor signals generated depending on the relative position between the sensor 26 and a detection object stationary on the ski, for example the thrust bearing 28, are transmitted via at least one line connection 32 to the evaluation device 14. The sensor 26 is preferably mounted stationary on the housing 24 of the heel binding 5 so that the line connection 32 between the evaluation device 14 and the sensor 26 can be integrated in such a way that it will function correctly for long periods. If the electronic board of the evaluation device 14 is designed accordingly, it would naturally also be possible for the sensor 26, as well as the sensor for detecting the Z number described above, to be mounted directly on the electronic board of the evaluation device 14 without separate line connections 18, 32.

In one advantageous embodiment, the evaluation device 14 provided in the heel binding 5 may also be connected to at least one other sensor 33 for detecting an open and/or closed state of a retaining jaw 34 of the heel binding 5. Like sensors 15, 16, 26 described above, this sensor 33 is also preferably provided in the form of a contactless transmitter or by a contactless detection sensor element. Sensor 33 is likewise connected to the evaluation device 14 in the heel binding 5. Depending on the layout, at least one line connection 35 may be provided between the sensor 33 and the evaluation device 14, as indicated by broken lines. Depending on the position of the clamping jaw 34, i.e. depending on whether the heel binding 5 is open or closed, different associated characteristic sensor signals are transmitted or supplied by at least one sensor 33. These various typical sensor signals are evaluated by the evaluation device 14 and a status of the sensor properties determined, enabling a conclusion to be drawn in respect of the prevailing coupling states of the ski binding 1 and the heel binding 5.

The sensor 33 primarily applies a control to ensure that the heel binding 5 is closed correctly. In particular, if the clamping jaw 34 is open or only partially closed, which might be the case if too much ice and/or snow has accumulated on the ski shoe for example, a message or a warning message, e.g. "Open", or a corresponding warning signal is indicated on the display device 7. This prevents premature or faulty release of the heel binding 5, which might otherwise be caused if the clamping jaw 34 were not fully in the closed position, because the user of the safety ski binding 1 would be alerted to the fact that something was not right. This improves the safety of the user of the safety ski binding 1 embarking on skiing sports as well as other persons who happen to be near him.

At least the detected values and/or the respective states of the heel binding 5 detected at any one time by the sensors are transmitted from the toe binding evaluation device 14 by the transmitter and/or receiver device 20 via a wireless data transmission on the basis of high-frequency signals and can therefore be received by the transmitter and/ receiver device 19 of the other coupling part, in particular the toe binding 4, and presented in an appropriate format on the display device 7 if necessary. Alternatively or in combination, the signals and data arriving at the evaluation device 13 may be further processed or memorised.

The transmitter and/or receiver device 19 and/or 20 may also be used to for a signal and data transmission to an external component, in particular an external, stand-alone electronic unit 36. This structurally separate electronic unit 36 might be a wrist-top computer 37, as schematically indicated, in other words a multi-purpose wrist watch, a personal data assistant (PDA), a stationary control device or any other mobile computer unit. Various states and setting values of the safety ski binding 1 can also be displayed on this electronic unit 36, if necessary, and the electronic unit 36 may be used to edit various settings and operating configurations, in which case this electronic unit 36 may optionally be used as a programming or maintenance device for the electronic system of the binding or circuit 6. Communication between the circuit 6 and the mobile electronic unit 36 is therefore preferably effected across a signal and data transmission route, indicated by a double arrow, without wires.

The transmitter and/or receiver devices 19, 20 are equipped with appropriate antenna systems, such as coils, dipoles or similar, for example, so that electromagnetic waves can be received and/or transmitted in the appropriate frequency range. As standard in the prior art, these transmitter and/or receiver devices 19, 20 also incorporate appropriate amplifiers and/or modulation and demodulation circuits. These transmitter and/or receiver devices 19, 20 act as the HF modules of the binding electronics and may also be designed to operate with so-called Bluetooth technology through the electronic modules. In particular, Bluetooth modules used as transmitter and/or receiver devices 19, 20 can be easily integrated in the binding electronics and then operated within existing Bluetooth systems and Bluetooth applications.

In another possible embodiment, the evaluation device 13 and/or 14 may also have an interface 38 which can be connected using contacts via a line or wire connection to an appropriate external electronic unit 36. This interface 38 may be used as a means of updating software or loading so-called firmware updates in the evaluation devices 13 and 14 and/or for retrieving characteristic values and so-called history data recorded and stored in the evaluation devices 13, 14.

Figure 2:
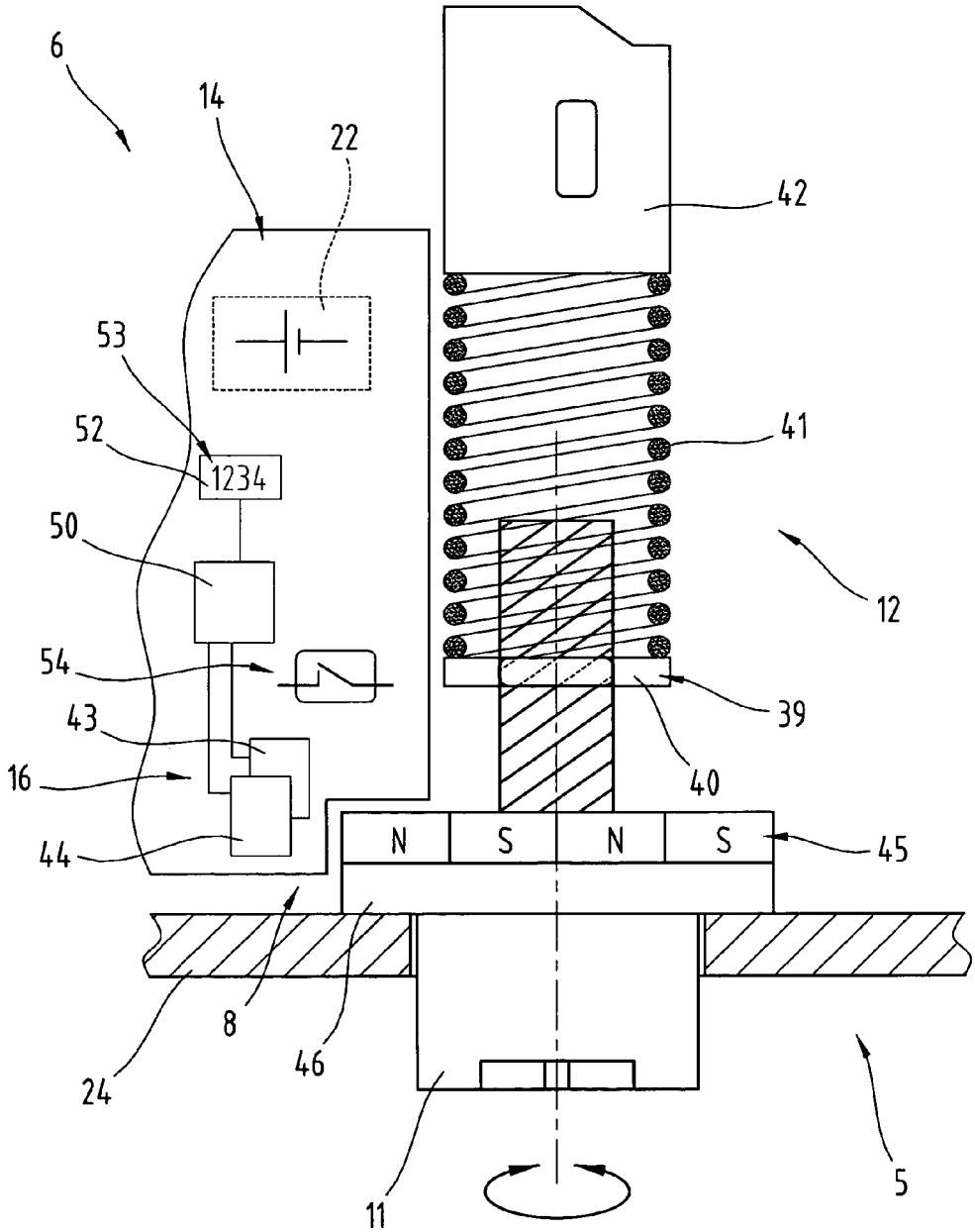
FIG. 2 is a highly simplified, schematic diagram showing one advantageous embodiment of the sensor system for electronically detecting the safety release value of the toe and heel binding.
Figure 3:
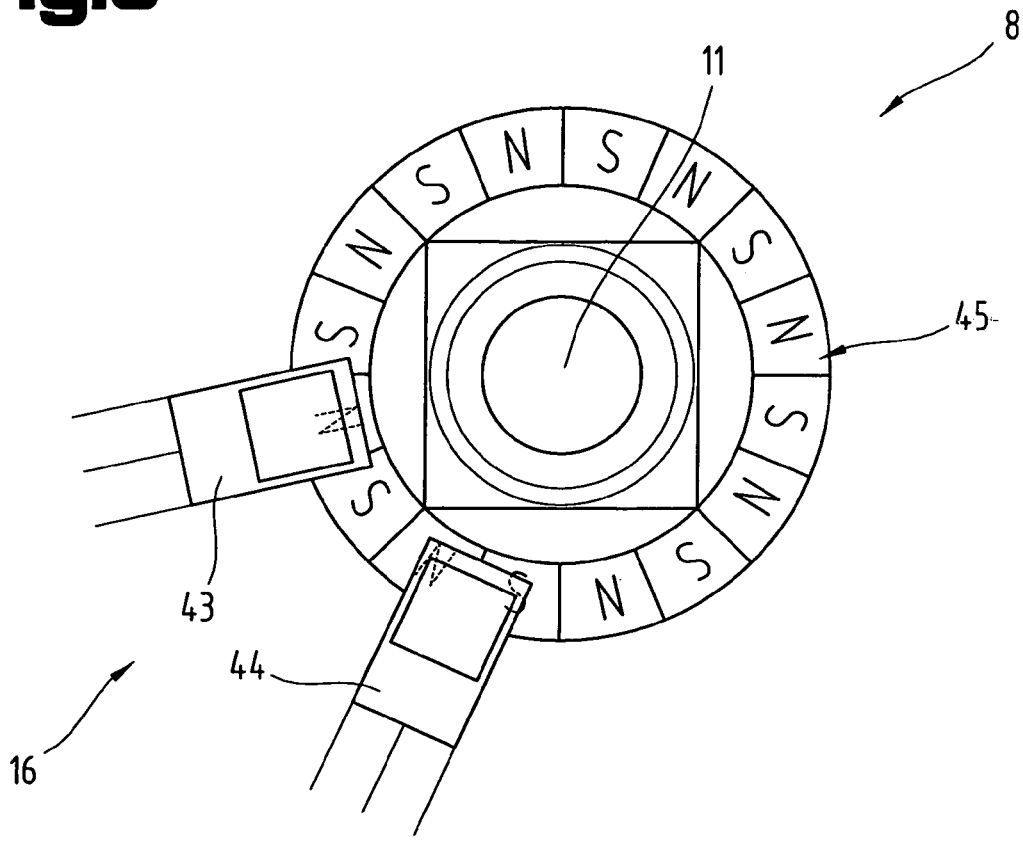
FIG. 3 is a simplified, schematic diagram showing a partial view of the sensor system illustrated in FIG. 2.

FIGS. 2 and 3 illustrate one advantageous embodiment of a sensor system 8 for electronically detecting or determining the set safety release value for at least one of the binding bodies.

For the sake of simplicity, the description below relates to a system in the rear binding part or heel binding 5. It goes without saying that a sensor system 8 of this type may also be fitted in the front binding body.

Accordingly, the sensor system 8 co-operates with the release mechanism 12 in order to detect the respective setting of the safety release value and the prevailing set Z number. The release mechanism 12 preferably comprises a screw nut 39 displaceably mounted on the adjusting screw 11 acting as a variably positionable thrust bearing 40 for an elastic element, preferably for a helical spring 41, which determines the safety release value of the binding body. This releasing or helical spring 41 can therefore be adjusted so as to exert a variable clamping pressure and this adjustment can be made by means of the adjusting screw 11 which is forced against a displaceably mounted piston 42, which is in turn coupled with the mechanical parts for coupling the sports shoe, in particular with the sole holder.

The sensor 16 is preferably provided in the form of a transmitter sensitive to magnetic fields or magnetic field sensor. In particular, the sensor 16 used to detect the respectively set safety release value is provided in the form of at least two Hall-effect sensors 43, 44. Disposed within their detection range is a ring magnet 45. This ring magnet 45 is coupled with the adjusting screw 11 so as to be integral with it in displacement and is so in such a way that as the adjusting screw 11 is turned, this ring magnet 45 is also turned by exactly the same degree. The ring magnet 45 preferably cooperates with a flange or collar 46 of the adjusting screw 11. The adjusting screw 11 is rotatably mounted in the relevant housing of the binding body, in this particular example in the housing 24. This adjusting screw 11 is mounted in the housing in such a way that it is displaceable in rotation but remains stationary in terms of its position, in other words its position does not change. The adjusting screw 11 is specifically supported on the housing 24 of the binding body by means of the collar 46, and the variably adjustable clamping force of the helical spring 41 is adjusted by means of the screw nut 39 which is relatively displaceable on the thread of the adjusting screw 11.

When the adjusting screw 11 is rotated, the ring magnet 45 is therefore moved with it, which thus changes the alignment or orientation, in particular the polar orientation, of the magnetic fields of its multiple permanent magnets. North and south poles of permanent magnetic elements are preferably disposed consecutively in an alternating arrangement around the peripheral region of the ring magnet 45. The change in the magnetic field or the polar arrangement of the ring magnet 45 which occurs when the adjusting screw 11 is turned can be detected by the two Hall-effect sensors 43, 44 and acts on the ring magnet 45 depending on its relative position with respect to the Hall-effect sensors 43, 44 and their electric signal states.

The Hall-effect sensors 43, 44 are spaced at a distance apart from one another in the circumferential direction of the ring magnet 45. An offset between the Hall-effect sensors 43, 44 is specifically selected so that one of the sensors lies congruently with one pole of the ring magnet 45, for example with the north pole, whilst the other sensor is assigned to the transition region between north and south pole. This spatial shift or this spacing between the first Hall-effect sensor 43 and the second Hall-effect sensor 44 in the circumferential direction of the ring magnet 45 produces sensor signals 47, 48 with a mutual phase shift—as may best be seen from a comparison with FIG. 4. Depending on the phase position of the sensor signals 47 of the first Hall-effect sensor 43 relative to the phase position of the sensor signals 48 of the second Hall-effect sensor 44, a conclusion can then be drawn with regard to the respective direction of rotation of the adjusting screw 11. Providing two Hall-effect sensors 43, 44 effectively enables the direction of rotation to be detected, which enables both an increase in the safety release value and a decrease in the safety release value to be detected via this sensor system 8.

Instead of providing two structurally separate Hall-effect sensors 43, 44, another option would be to use a combined Hall-effect transmitter, in particular a so-called dual-Hall-effect sensor with integrated direction detection. Likewise, instead of using a multi-pole ring magnet 45, it would also be possible to provide a plurality of individual permanent magnets on the rotation circumference of the adjusting screw 11.

Figure 4:
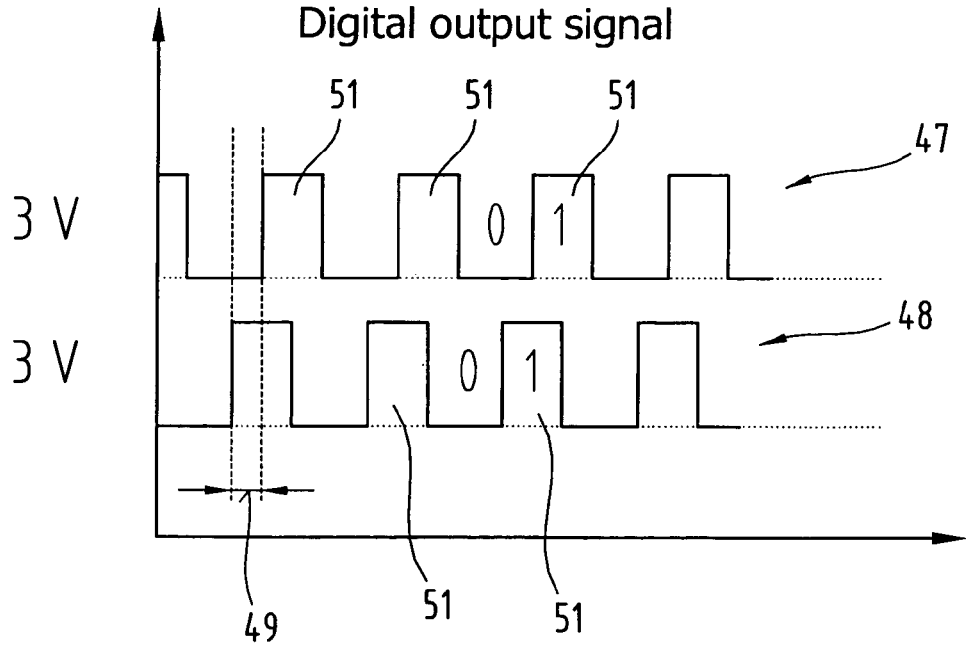
FIG. 4 is a simplified, schematic diagram showing the digital output signals of the sensor system illustrated in FIG. 2 and FIG. 3.

As may also be seen from comparing FIGS. 2, 3 and FIG. 4, the Hall-effect sensors 43, 44 are preferably provided in the form of what are known as Hall-effect switches or Hall-effect latches, which deliver or generate a digital output or sensor signal 47, 48. The Hall-effect-sensors 43, 44 could also be described as digital magnetic field sensors. FIG. 4 also illustrates the time shift or phase shift 49 between the first sensor signal 47 and the second sensor signal 48.

The pulses 51 of at least one sensor signal 47, 48 are counted by means of at least one electronic counter 50 or so-called pulse counter of the evaluation device 14. Depending on the direction in which the adjusting screw 11 is rotated and depending on the phase shift of the sensor signal 47 of the first Hall-effect sensor 43 relative to the sensor signal 48 of the second Hall-effect sensor 44, a numerical value 53 of previous rotations of the adjusting screw 11 stored in a non-volatile memory system 52 is increased or decreased accordingly. The respective set safety release value or Z number can be calculated by the evaluation device 14 depending on the numerical value 53 of the pulses 51 of the sensor signal 47 as it is updated when the adjusting screw 11 is turned, and transmitted for display purposes.

The sensor signals 47, 48 of the sensor 16 which is sensitive to magnetic fields is preferably a digital voltage signal, thereby offering high resistance to interference and good functional reliability. Provided steps were taken to deal with certain drawbacks, such as the need for AID conversion, signal shaping and such like, the sensor signals 47, 48 could also be analogue signals, for example in the form of more or less sinu-soidal voltage signals from an analogue Hall-effect sensor. Pulses or half waves of the analogue sensor signal could also be counted or evaluated if using signals of this type.

The sensor 16 used to detect the safety release value is therefore not a force or pressure sensor as such, or an absolute measurement value or position transmitter, but is based on an incremental measuring method with a so-called incremental sensor or incremental transmitter. The Z number prevailing at any one time is specifically detected by recording the rotating movements of the adjusting screw 11 and the respective value of the setting is permanently stored in the memory system 52 or in the evaluation device 14 until the next update or change. The memory system 52 used for storing at least a numerical value 53 may be an EEPROM-memory, the memory contents of which continue to be saved in the long term even if the battery or power supply system 22 is cut off.

The zero setting or adaptation of the numerical value 53 to the respective position of the adjusting screw 11 and the respective safety release value is taken care of in the factory. It is also possible for the electronics to be adapted to the mechanics or the zero or reference point set subsequently, for example by the user or more preferably by an authorised service centre. In view of the fact that the service life of the power supply of the evaluation device 14 can be made to last longer than an average product life of the safety ski binding 1, it may also happen that pulses 51 of the sensor signal 47 and/or 48 never remain unevaluated as long as the power supply remains intact, in which case there are no circumstances under which the adjusting screw 11 or 9 can be rotated without this being recorded by the relevant electronic evaluation device 14 or 13.

The evaluation device 14 and 13 preferably has a software-driven, programmable micro-controller. A digital evaluation device 14 and 13 is provided in particular, in which case the micro-controller used will have access to internal and/or external memory systems, in particular programme memories, as well as volatile and/or non-volatile data memories, such as RAM, EEPROM, PROM and/or flash memory elements, for example.

In order to keep the power consumption of the electronic evaluation device 13 in the toe binding 3—see FIG. 1—and the electronic evaluation device 14 in the heel binding 5 as low as possible, the evaluation device 13 and/or 14 of one advantageous embodiment may co-operate with a motion sensor 54. The purpose of this motion sensor 54 is to detect any movements of the safety ski binding 1 and forward this information to the evaluation device 13 or 14 by means of appropriate signals. If no movements are recorded by the motion sensor 54 during a predefined period, the evaluation device 13 and/or 14 or any other electrical components of the circuit 6 are switched off or switched to an operating mode which consumes less power, in particular a so-called "sleep mode" or a "standby mode". In this sleep mode or power-saving mode, the evaluation device 13 or 14 will be programmed to evaluate the signal states of the motion sensor 54 as a priority, whereas other functions of the evaluation device 13 or 14 will be deactivated or minimised. As soon as sufficient movements of the safety ski binding 1 are detected by the motion sensor 54, the circuit 6 and at least the respective electronic evaluation device 13 or 14 is switched back on or returned to the active operating mode. This will specifically enable the power consumed by the electronic circuit 6 and the evaluation devices 13 and 14 to be significantly reduced or reduced to zero, for example during the summer period or at times when the safety ski binding 1 is usually not being used.

This motion sensor 54 may be mounted directly on the component board of the evaluation device 13 and/or 14 or on the housing 24 and/or 25 of the binding of the safety ski binding 1. Motion sensors 54 of this type are known from the prior art and are so in a whole range of designs. One particular option is to provide the motion sensor 54 in the form of at least one resiliently mounted electric reed switch and/or a liquid switch, in particular a mercury switch.

In one advantageous embodiment, the display device 7—FIG. 1—may be switched or directly controlled by the motion sensor 54 depending on the signals of the motion sensor 54 or depending on a period which elapses without any movement being recorded by the evaluation device 13 or 14, in order to minimise power consumption of the display device 7. This specifically enables the display device 7 to be automatically switched off or switched to a power-saving mode during inactive periods in which the display functions are not needed. Likewise, the electronic evaluation device 13 or 14 can be switched off or switched to a power-saving mode if the signal status of the at least one motion sensor 54 has remained constant over a specific period of time. The same applies to other components of the circuit 6.

As an alternative, however, the power consumption of the electronic circuit 6 can be reduced by switching the display device 7 off whenever there is a change from the closed or operation-ready state to the open state of the skin binding 1 or heel binding 5 detected via the evaluation device 13 in the toe binding 4—FIG. 1. In other words, when the user removes the ski shoe from the binding, the display device 7 can be switched off instantaneously or after a specific delay in order to minimise or stop power consumption by the display device 7.

Another possible embodiment which has the advantage of making a further saving in electrical power consumption is one in which at least one of the sensors 15, 16, 26, 33 described above is periodically activated and deactivated. In particular, at least one sensor 15, 16, 26, 33 can be briefly activated at intervals of 0.1 seconds, for example, and then deactivated again. It is of particular advantage if at least one of the sensors 15, 16, 26, 33 is operated in so-called scan-mode. This being the case, a high scan ratio of 1:500, for example, can be selected between the switching on and off period. The power consumption is then reduced by approximately the same respective factor, for example by a factor of 500 if the scan ratio is 1:500. The power consumption of the circuit 6 will be extremely low or significantly reduced as a result, which will either enable operation over long periods of time without maintenance or permit the use of a plurality of relatively small power supply systems 21 or 22 with a lower capacity. Provided the scanning rate is high enough or a sensor 15, 16, 26, 33 is operated in a suitably fast scan mode via the respective evaluation device 13 and 14, the risk of data or information being lost can be ruled out.

The embodiment of the release mechanism 12 illustrated in FIG. 2 should not be construed as restrictive and in fact the sensor system 8 and sensor technology described may also be used as a means of detecting the safety release values set on any other types or designs of release mechanism.

Instead of using so-called Hall-effect switches or Hall-effect latches, it would also be conceivable to replace the Hall-effect sensors 43, 44 with what are known as reed switches, which are closed or opened depending on the position or rotation of the adjusting screw 11 and the permanent magnet ring or ring magnets 45, by means of which a digital output signal can also be produced or generated, which can be easily processed by the electronic evaluation device 13 or 14 by counting the corresponding signal pulses or periods of the switch signal. This approach also enables the adjustment width and the rotation angle, which may be more than 360°, and the direction of rotation of adjusting screw 11 or adjusting screw 9 to be recorded so that it can be taken into account by the evaluation device 14 and 13 to ascertain the respective safety release values or the Z number.

Figure 5:
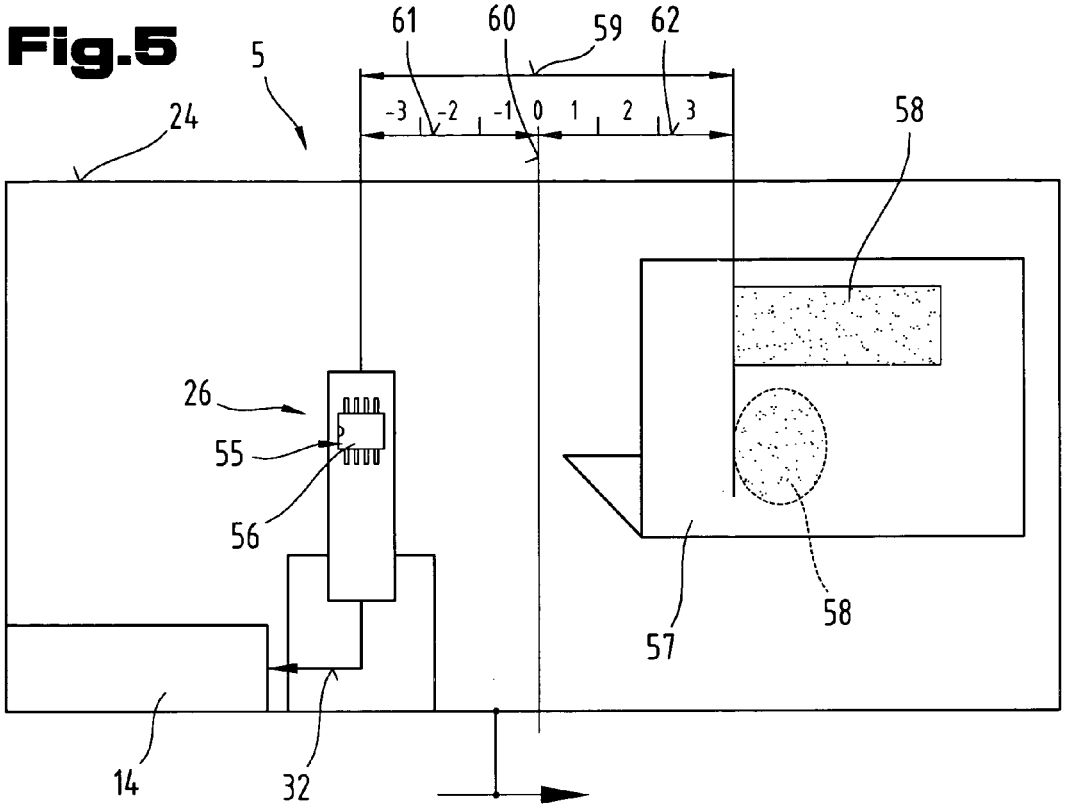
FIG. 5 is a highly simplified, schematic diagram showing one advantageous embodiment of the sensor system for detecting the clamping pressure exerted by the slip-on spring system of a ski binding on a ski shoe.

FIG. 5 is a schematic diagram illustrating an advantageous embodiment of the sensor system used to detect the clamping pressure of the ski binding 1, in particular the heel binding 5, on a ski shoe inserted in it. The sensor 26 which detects the clamping pressure is accommodated in the interior of the housing 24. The sensor 26 is preferably secured to the housing 24 so that it is prevented from moving and communicates via at least one line connection 32 with the electronic evaluation device 14 for signal processing purposes.

The sensor 26 is preferably provided in the form of a magnetic field sensor 55, in particular a GMR sensor 56 (Giant Magneto-Resistive Sensor). A magnetic field sensor 55 of this type or a so-called GMR Sensor 56 will enable the linear position of the housing 24 to be determined relative to a fixed position of the binding or the board-type sports device. This fixed position might be a part, such as a metal part 57 of the binding and/or at least one permanent magnet 58. This permanent magnet 58 may be bar-shaped or disc-shaped. Depending on the distance 59 between the metal part 57 or permanent magnet 58 to be detected and the magnetic field sensor 55, the magnetic field sensor 55 will emit a characteristic sensor signal which is transmitted via the line connection 32 to the evaluation device 14. This magnetic field sensor 55 or GMR sensor 56 therefore enables a genuine distance measurement to be taken on the slip-on spring system in the heel binding 5, thereby enabling a conclusion to be drawn as to whether the slip-on spring system is applying the correct or optimal clamping pressure.

As schematically illustrated, when a user steps into the ski binding, the housing 24 moves in the direction indicated by the arrow relative to the co-operating metal part 57 or permanent magnet 58 disposed within the detection range, thereby altering the electromagnetic properties of the magnetic field sensor 55. A measurement range or maximum measurement length of the magnetic field sensor 55 is therefore approximately 20 mm, preferably approximately 10 mm. The maximum measurement range of the magnetic field sensor 55 is preferably bisected and a reference point 60 is defined in the middle range of the maximum measuring distance, which is the point of optimum clamping pressure. At values below or on the left-hand side or values above or on the right-hand side of the reference point 60, the clamping pressure is too low or too high.

By preference, this magnetic field sensor 55 not only makes it possible to determine an optimum or not optimum clamping pressure, it may also be used to detect intermediate stages of the clamping pressure conditions. In particular, one measurement range 61 covers too low a clamping pressure and another measurement range 62 is used to detect too high a clamping pressure. Each of these measurement ranges 61, 62 can in turn be divided into low, medium and high ranges, so that variances from the desired clamping pressure setting symbolised by the reference point 60 can be detected and indicated on the display device 7—FIG. 1. The essential factor is that a specific range of values on either side of the reference point 60 is defined, at which the clamping pressure is deemed to be optimum or correct in order to prevent meaningless fluctuations from being shown on the display.

The fact that the magnetic field sensor 55 or the GMR sensor 56 enables a distance measurement to be taken means that six or seven different value ranges can be defined for the prevailing clamping pressure, for example, which means that respective clamping pressures can be determined virtually indirectly and presented in an appropriate format on the display device 7. To this end, the signals from the magnetic field sensor 55 or GMR sensor 56 are evaluated and transmitted wirelessly from the evaluation device 14 to the display device 7 or to the evaluation device 13 upstream of it—FIG. 1.

With this type of magnetic field sensor 55 or GMR sensor 56, there is a largely linear rise or fall in voltage depending on the distance of its sensor surface from the metal part 57 or permanent magnet 58 to be detected. A voltage rise or voltage fall of 30–80 mV (millivolt) per 1 mm change in distance will produce a good and relatively high resolution of the measured distance and the correlated spring force or clamping force of the slip-on spring system.

Figure 6:
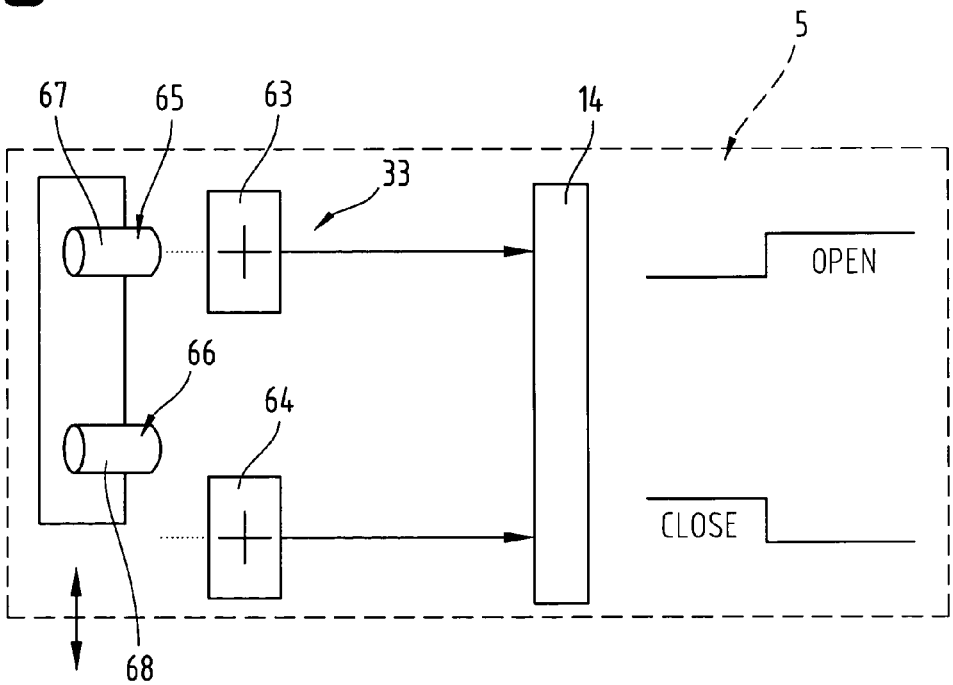
FIG. 6 is a highly simplified, schematic diagram showing one advantageous embodiment of the sensor system for detecting the open and closed state of a safety ski binding.

FIG. 6 illustrates one advantageous embodiment of the sensor system used to detect the open and closed state of the binding part, in particular the heel binding. The sensor 33 used to detect the closed and open position of the binding body is preferably provided in the form of a first Hall-effect sensor 63 and a second Hall-effect sensor 64. In the open position symbolically indicted in FIG. 6, a detection object 65 to be detected lies within the detection range of the first Hall-effect sensor 63, whereas another detection object 66 of the binding lies outside the detection range of the other Hall-effect sensor 64. The detection objects 65, 66 are preferably provided in the form of appropriate permanent magnets 67, 68. When the binding is closed, in which case the ski shoe is inserted in the ski binding, the detection objects 65, 66 are moved downwards as indicated by the double arrow. When the binding is in the correctly closed state, detection object 66, in particular the permanent magnet 68, lies within the detection range of the other Hall-effect sensor 64, whereas detection object 65 lies outside the detection range of the Hall-effect sensor 63 and the Hall-effect sensor 63 now emits or causes a different sensor signal typical for this state.

The reliability and accuracy of the detection system can be improved by using this quasi redundant dual approach to detect the open and closed state with two Hall-effect sensors 63, 64. This approach specifically avoids any inadmissible or safety-critical intermediate positions between the open and the closed state to be detected. The different electrical properties or signals of the Hall-effect sensors 63, 64 which occur depending on the relative position of the detection object 65, 66 with respect to the cooperating Hall-effect sensor 63, 64 are evaluated by the evaluation device 13, thereby enabling a conclusion to be drawn about the corresponding position of the heel binding 5 and its clamping jaw 34—FIG. 1.

Instead of using permanent magnets 67, 68 as relatively displaceable detection objects 65, 66, it would also be possible to use relatively displaceable metal parts. In this case, the permanent magnets 65, 66 are disposed directly against or on the Hall-effect sensors 63, 64.

As an alternative to Hall-effect sensors 63, 64, it would naturally also be possible to use at least two reed switches, which would assume an open or closed electrical switch contact depending on the relative position with respect to the respective cooperating permanent magnets.

The essential factor is that in order to detect the open and closed state of the ski binding or heel binding, at least one sensor that is sensitive to magnetic fields, preferably two sensors that are sensitive to magnetic fields, is or are used.

These Hall-effect sensors 63, 64 or reed switches are preferably secured on the heel binding so as to be immobile. The respective detection objects 65, 66, in other words the permanent magnets 67, 68 or at least a metal part acting on the permanent magnetic field around the sensor, is preferably disposed so that it is relatively displaceable by mounting it on a rotation axis of the pivot pin for the clamping jaw 34, for example, or directly on the pivotably mounted clamping jaw 34—FIG. 1.

Whether or not the position of a magnet or a metal part will be determined depends solely on whether the magnet can be displaced relative to the Hall-effect sensor 63, 64 or whether it is disposed directly on the fixed Hall-effect sensor 63, 64, and the fact that the magnetic field of the permanent magnets 67, 68 is changed as an appropriate metal part is moved towards or away from it. This change can be effectively detected by the Hall-effect sensor 63, 64 and its electrical properties acted on, which enables the evaluation device 14 to draw a conclusion about the respective relative position between the Hall-effect sensor 63, 64 or the cooperating magnetic field sensor and the metal part or permanent magnet 65, 66.

For the sake of good order, it should finally be pointed out that in order to provide a clearer understanding of the structure of the safety ski binding 1, it and its constituent parts are illustrated to a certain extent out of scale and/or on an enlarged scale and/or on a reduced scale and in a highly schematic format.

The independent solutions proposed by the invention and the associated objectives may be found in the description.

Above all, the individual embodiments illustrated in FIGS. 1; 2, 3; 4; 5; 6 constitute independent solutions proposed by the invention. The objectives and associated solutions may be found in the detailed description of these drawings.

What is claimed is:

1. A safety ski binding comprising (a) a toe binding, (b) a heel binding, (c) an electronic circuit incorporating (1) a single electronic display device arranged either in the toe binding or the heel binding for visualizing respective values or states of the toe binding or heel binding and (2) a sensor system for displaying a set safety release value of the safety ski binding, (d) an electronic evaluation device in the toe binding and in the heel binding, each electronic evaluation device having (1) a sensor for detecting the set safety release value, (e) separate power supply systems in the toe binding and in the heel binding for each electronic evaluation device, and (f) each electronic evaluation device having a transmitter and receiver device for a wireless, one-way or two-way data or signal transmission therebetween.

2. The safety ski binding of claim 1, wherein the single electronic display device is capable of generating a graphic display.

3. The safety ski binding of claim 1, comprising a slip-on spring system in the heel binding, and wherein the electronic evaluation device in the heel binding is connected to a sensor for determining or checking a clamping pressure of the spring system relative to a ski shoe held by the heel binding.

4. The safety ski binding of claim 3, wherein the sensor for determining or checking the clamping pressure is a magnetic field sensor.

5. The safety ski binding of claim 4, wherein the magnetic field sensor is a Giant Magneto Resistive sensor.

6. The safety ski binding of claim 4, comprising a heel binding housing enclosing a slip-on spring system, the magnetic field sensor being immovably joined to the housing, and a permanent magnet or metal part disposed on a part of the slip-on spring system that is displaceable relative to the magnetic field sensor.

7. The safety ski binding of claim 6, wherein the Hall effect sensors are spaced apart at a distance from each other in the circumferential direction of the ring magnet, the Hall effect sensors generating a digital sensor signal upon turning of the adjusting screw, and the electronic evaluation device comprises a counter for counting or recording the pulses or periods of the sensor signal.

8. The safety ski binding of claim 1, wherein the electronic evaluation device in the heel binding is connected to a sensor for detecting the open and closed state of the heel binding.

9. The safety ski binding of claim 8, wherein the sensor for detecting the open and closed state of the heel binding is comprised of a first Hall effect sensor for signaling the open state and a second Hall effect sensor for signaling the closed state.

10. The safety ski binding of claim 8, wherein a numerical value representing the counted or recorded pulses or periods stored in a non-volatile memory system is increased or decreased by turning the adjusting screw, depending on the direction in which the adjusting screw is turned.

11. The safety ski binding of claim 1, wherein the electronic evaluation device in the heel binding is connected to a sensor for detecting the open or closed state of the heel binding.

12. The safety ski binding of claim 1, wherein the sensor for detecting the set safety release value is comprised of two Hall effect sensors, and a multi-pole ring magnet rotatingly joined to an adjusting screw for adjusting the release values of a release mechanism is disposed in the detection range of the Hall effect sensors.

13. The safety ski binding of claim 1, wherein the electronic evaluation device is designed to activate or deactivate the power supply of at least one sensor.

14. The safety ski binding of claim 1, comprising a motion sensor connected to each electronic evaluation device.

15. The safety ski binding of claim 1, comprising a motion sensor connected to the electronic evaluation device in the toe binding or to the electronic evaluation device in the heel binding.

16. The safety ski binding of claim 15, wherein the electronic evaluation device is designed to be switched off or switched to a power-saving mode if the signal status of the motion sensor remains constant for a specific period of time.

17. The safety ski binding of claim 16, wherein the electronic evaluation device is designed primarily to evaluate the signal status of the motion sensor in the power-saving mode, and other functions of the evaluation device are deactivated or minimized.

18. The safety ski binding of claim 15, wherein the electronic display device is designed to be switched off, depending on signals of the motion sensor and on a period of time elapsing without any movement being detected by the evaluation device or the motion sensor.

19. The safety ski binding of claim 1, wherein the electronic evaluation device in the toe binding is designed to switch off the electronic display device or to switch it to a power-saving mode if the heel binding changes from a closed to an open state.

20. The safety ski binding of claim 1, wherein the transmitter and receiver device is comprised of a peripheral electronic computer unit.

21. The safety ski binding of claim 20, wherein the computer unit is comprised of a wrist-top computer, a hand-held computer, or a mobile telephone.

* * * * *